US006498424B1

(12) United States Patent
Saito et al.

(10) Patent No.: US 6,498,424 B1
(45) Date of Patent: Dec. 24, 2002

(54) FIELD EMISSION TYPE CATHODE, ELECTRON EMISSION APPARATUS AND ELECTRON EMISSION APPARATUS MANUFACTURING METHOD

(76) Inventors: Ichiro Saito, c/o Sony Corporation 7-35, Kitashinagawa, 6-chome, Shinagawa-ku, Tokyo (JP); Kouji Inoue, c/o Sony Corporation 7-35, Kitashinagawa, 6-chome, Shinagawa-ku, Tokyo (JP); Shinichi Tachizono, c/o Hitachi Powdered Metals, Co., Ltd., 1519, Mito, Tako-machi, Katori-gun, Chiba-ken (JP); Takeshi Yamagishi, c/o Hitachi Powdered Metals, Co., Ltd. 676, Tako, Tako-machi, Katori-gun, Chiba-ken (JP)

( * ) Notice: Subject to any disclaimer, the term of this patent is extended or adjusted under 35 U.S.C. 154(b) by 0 days.

(21) Appl. No.: 09/551,877

(22) Filed: Apr. 18, 2000

(30) Foreign Application Priority Data

Apr. 21, 1999 (JP) ..... 11-113805

(51) Int. Cl.[7] ..... H01J 1/02
(52) U.S. Cl. ..... 313/309; 313/310; 313/351
(58) Field of Search ..... 313/309, 310, 313/495, 336, 351, 346 R, 311

(56) References Cited

U.S. PATENT DOCUMENTS 5,666,022 A * 9/1997 Deckers et al. ..... 313/346 DC
5,675,216 A * 10/1997 Kumar et al. ..... 313/495
5,709,577 A * 1/1998 Jin et al. ..... 445/24
5,828,162 A * 10/1998 Danroc et al. ..... 313/309
5,977,697 A * 11/1999 Jin et al. ..... 313/310
6,031,328 A * 2/2000 Nakamoto ..... 313/495
6,097,139 A * 8/2000 Tuck et al. ..... 313/310

FOREIGN PATENT DOCUMENTS

JP 01-173555 7/1989

OTHER PUBLICATIONS

Jaszczak, John A. Graphite. [online], [retrieved on Jan. 7, 2002]. Retrieved from the <URL:www.phy.mtu.edu/faculty/info/jaszczak/graphiteover.html>.*
Geis M W et al: "Diamond Grit–Based Field Emission Cathodes" IEEE Electron Device Letters, US, IEEE Inc. New York, vol. 18, No. 12, Dec. 1, 1997, pp. 595–598.
Fan S et al: "Self–Oriented Regular Arrays of Carbon Nanotubes and Iheir Field Emission Properties" Science, American Association for the Advancement of Science,,US, vol. 283, Jan. 22, 1999, pp. 512–514.

* cited by examiner

*Primary Examiner*—Robert H. Kim
*Assistant Examiner*—Jurie Yun

(57) ABSTRACT

To form a sharp edge portions of an electron emission part of a field emission type cathode to face an electron application surface. At least an electron emission part 40 of a field emission type cathode K is constituted by stacking thin plate-like conductive fine grains 30 and the field emission type cathode K is formed so that the plane direction of the thin plate-like fine grains of the electron emission part 40 crosses an electron application surface.

42 Claims, 9 Drawing Sheets

FIELD EMISSION TYPE CATHODE, ELECTRON EMISSION APPARATUS AND ELECTRON EMISSION APPARATUS MANUFACTURING METHOD

BACKGROUND OF THE INVENTION

1. Field of the Invention

The present invention relates to a field emission type cathode, an electron emission apparatus and an electron emission apparatus manufacturing method.

2. Description of the Related Art

There have been proposed various types of electron emission apparatuses having field emission type cathodes, such as a planar display apparatus, i.e., a panel type display apparatus. As for an apparatus for making a bright image display, a cathode ray-tube type structure for striking an electron beam on the fluorescent surface of an image formation plane to thereby emit light, is normally adopted.

As proposed in, for example, Japanese Patent Application Laid-Open (JP-A) No. 1-173555, a conventional planar display apparatus of a cathode ray-tube type structure is such that a plurality of thermoelectron emission cathodes, i.e., filaments are provided to face a fluorescent surface, thermoelectrons generated by these cathodes and secondary electrons resulting from the thermoelectrons are allowed to direct toward the fluorescent surface and that according to an image signal an electron beam excites the respective colors on the fluorescent surface to cause light emission. In this case, as the image plane becomes larger in size, the filaments are provided in common for many pixels, that is, many red, green and blue fluorescent substance trio forming the fluorescent surface.

Accordingly, as the image plane becomes, in particular, larger in size, the arrangement and assembly of the filaments become more complicated.

Furthermore, to make the planar display apparatus of the cathode ray-tube structure small in size, the length of the electron gun is decreased and the deflecting angle of electrons is widened to shorten the depth dimension of the apparatus. However, since the image plane of a planar display apparatus is becoming wider in recent years, the development of thinner planar display apparatuses is desired.

In the meantime, as for the conventional planar display apparatus, there is proposed an apparatus using field emission type cathodes or so-called cold cathodes. The structure of an example of such planar type display apparatus will be described hereinafter with reference to the drawings.

The planar display apparatus 100 shown in FIG. 15 consists of a fluorescent surface 101, a planar white light emission display apparatus main body 102 having field emission type cathodes K arranged to face the fluorescent surface 101 and a planar color shutter 103 arranged to contact or face the front surface of the apparatus at the side at which the fluorescent surface 101 is arranged.

In the display apparatus main body 102, as shown in FIG. 15, a light transmitting front panel 104 and a back panel 105 face each other through a spacer (not shown) holding the panels 104 and 105 at predetermined intervals. The peripheral edges thereof are airtight sealed by glass frit or the like and a flat space is formed between the panels 104 and 105.

An anode metal layer 160 and the fluorescent surface 101 entirely coated with, for example, white light emission fluorescent material in advance are formed on the inner surface of the front panel 104. A metal back layer 106 such as an Al film as in the case of an ordinary cathode ray-tube is coated on the surface of the fluorescent surface 101.

On the other hand, many cathode electrodes 107 extending in perpendicular direction in, for example, a band-like manner are arranged in parallel to one another and coated on the inner surface of the back panel 105.

An insulating film 108 is coated on the cathode electrodes 107 and gate electrodes 109 extending to be almost orthogonal to the extension direction of the cathode electrodes 107, for example, horizontally are arranged in parallel to one another on the insulating film 108.

Holes 110 are formed at the crossings of the cathode electrodes 107 and the gate electrodes 109, respectively. In these holes 110, conical field emission type cathodes K are formed to be coated on the cathode electrodes 107, respectively.

Each of the field emission type cathodes K is made of a material, such as Mo, W and Cr, which emits electrons by a tunnel effect when applied with a field of, for example, about $10^6$ to $10^7$ (V/cm).

To help understand the configuration of a cathode structure including the field emission type cathode K, the gate electrode and the like which constitute the planar display apparatus 100 of the above-stated conventional structure, one example of the configuration as well as its manufacturing method will be described with reference to manufacturing step views shown in FIGS. 16 to 19.

First, as already described with reference to FIG. 15, cathode electrodes 107 are formed on the inner surface of the back panel 105 along one direction, e.g., vertical scan direction.

Each of the cathode electrode 107 is configured such that a metal layer made of, for example, Cr is formed entirely by deposition, sputtering or the like and selectively etched by photolithography, to thereby form the cathode electrode 107 into a predetermined pattern.

Next, as shown in FIG. 16, on the patterned cathode electrode 107, an insulating film 108 is coated on the entire surface thereof by sputtering or the like and a metal 111 such as high melting point metal of, for example, Mo or W, finally constituting a gate electrode 109 is formed on the insulating film 108 by deposition, sputtering or the like.

As shown in FIG. 17, a resist pattern made of, for example, a photoresist, though not shown therein, is formed. Using the resist pattern as a mask, anisotropic etching such as RIE (reactive ion etching) is conducted to the metal layer 111 to thereby form a band-shaped gate electrode 109 in a predetermined pattern, i.e., extending in the horizontal direction orthogonal to the extension direction of the cathode electrode 107 shown in FIG. 15. Also, a plurality of small holes 111*h*, for example, are provided at crossings of the gate electrodes 109 and the cathode electrodes 107, respectively.

Next, through these small holes 111*h*, chemical etching with which the gate electrode 109, that is, the metal layer 111 is not etched but the insulating layer 108 is isotropically etched, is conducted, thereby forming holes 112 each having a width larger than the width of the small hole 111*h* and a depth corresponding to the entire thickness of the insulating layer 108.

In this way, as shown in FIG. 15, holes 110 are formed out of the holes 112 and the small holes 111*h* at crossings of the cathode electrodes 107 and the gate electrodes 109, respectively.

Thereafter, as shown in FIG. 18, a metal layer 113 made of, for example, Al or Ni is coated on the gate electrode 109 by oblique deposition. The oblique deposition is carried out while rotating the back panel 105 in the plane, so that round holes 114 each having a conical inner periphery are formed around the small holes 111*h*, respectively.

In that case, the deposition of the metal layer 113 is carried out with a selected angle with which the metal layer 113 is not coated in the holes 112 through the small holes 111*h*.

Through the round holes 114, a field emission type cathode material, that is, a metal, such as W or Mo, having a high melting point and a low work function is deposited on the cathode electrode 107 in the hole 112 perpendicularly to the cathode electrode surface by deposition, sputtering or the like. In that case, even if deposited perpendicularly, the cathode material is formed to have an inclined surface continuous to those of the metal layer 113 around the round holes 114. Thus, if the cathode material reaches a certain thickness, the holes 114 become closed. As a result, in the respective holes 112, conical, dot-like cathodes K each having a triangle cross section are formed on the cathode electrodes 107, respectively.

Thereafter, as shown in FIG. 19, the metal layer 113 and the cathode material formed on the layer 113 described with reference to FIG. 18 are removed. By doing so, dot-like cathodes K of conical shape, that is, each having a triangle cross section are formed in the holes 110 on the band-like, that is, stripe cathode electrodes 107, respectively.

The insulating film 108 exists around the cathodes K, whereby the cathodes K are electrically isolated from the cathode electrodes 107 and a cathode structure is constituted such that the gate electrodes 109 having electron beam transmitting holes formed out of the above-stated small holes 111*h* to face the respective cathodes K are arranged.

In this way, the field emission type cathodes K are formed on the cathode electrodes 107, respectively. Further, the cathode structure having the gate electrodes 109 crossing above the cathodes K is arranged to face the white fluorescent surface 101.

In the display apparatus main body 102 constituted as stated above, high plate voltage which is positive relative to the cathodes is applied to the fluorescent surface 101, that is, the metal back layer 106. Besides, voltage with which electrons can be sequentially emitted from the field emission type cathodes at, for example, the crossings of the cathode electrodes 107 and the gate electrodes 109, is applied between the cathode electrodes 107 and the gate electrodes 109, for example, voltage of 100V is applied to the gate electrodes 109 with respect to the cathode electrodes 107 sequentially and according to the display contents. Thus, electron beams are directed toward the white fluorescent surface 101 from the tip end portions of the cathodes K.

As a result, a white picture having light emission patterns corresponding to the respective colors in a time-division manner is obtained from the display apparatus main body 102. In addition, synchronously with the time-division display, the color shutter 103 is switched to thereby fetch lights corresponding to the respective colors.

Namely, red, green and blue optical images are sequentially fetched, thus displaying a color image as a whole.

SUMMARY OF THE INVENTION

As stated above, in the planar display apparatus 100 of the conventional structure shown in FIG. 15, the field emission type cathodes K facing to the fluorescent surface 101 are formed to be conical and have a triangle cross section by the manufacturing steps described with reference to FIGS. 16 to 19, and the electric field is concentrated on the tip end portions of the cones to thereby emit electrons.

Nevertheless, as the present development of technology progresses, it is desired that the electron emission parts of the field emission type cathodes K constituting this planar display apparatus 100 are formed to be more efficiently sharp.

Furthermore, as already described with reference to FIGS. 16 to 19, if cathodes K are formed, the radius of curvature of the tip end portion of each cathode K is relatively low or several tens of nanometers, e.g., about 60 nm. To satisfy today's high resolution, it is necessary to form a finer tip end portion so as to efficiently concentrate an electric field and to efficiently emit electrons.

Under the circumstances, the inventors of the present invention continued dedicated efforts and studies and have eventually provided a field emission type cathode, an electron emission apparatus and an electron emission apparatus manufacturing method capable of making the electron emission part of a field emission type cathode K constituting a planar display apparatus finer and sharper to allow concentrating the field more efficiently.

A field emission type cathode according to the present invention is a field emission type cathode arranged to face an electron application surface, characterized in that at least an electron emission part of the field emission type cathode is formed by thin plate-like conductive fine grains; and a plate surface direction of the thin plate-like fine grains of the electron emission part is arranged to be a direction mainly crossing the electron application surface.

An electron emission apparatus according to the present invention is an electron emission apparatus having field emission type cathodes arranged to face an electron application surface, characterized in that at least electron emission parts of the field emission type cathodes are formed by thin plate-like conductive fine grains; and a plate surface direction of the thin plate-like fine grains of the electron emission part is arranged to be a direction mainly crossing the electron application surface; and if an electric field is applied, electrons are emitted from end faces of the thin plate-like fine grains of the electron emission parts of the field emission type cathodes.

An electron emission apparatus manufacturing method according to the present invention is characterized by comprising the steps of: forming a photoresist pattern having predetermined holes on formation surfaces of field emission type cathodes constituting an electron emission apparatus; dispersing thin plate-like conductive fine grains into a solvent and making an coating agent; coating and drying said coating agent on said photoresist pattern; and removing said photoresist pattern, and in that a plate surface direction of said thin plate-like fine grains in said holes and on wall portions of said holes is arranged to be a direction mainly crossing said electron application surface.

According to the field emission type cathode of the present invention and the electron emission apparatus having the field emission type cathodes of the present invention as constituent elements, the electron emission parts of the field emission type cathodes are formed by thin plate-like fine grains and also the plate surface direction of the thin plate-like fine grains are arranged to be a direction mainly crossing the electron application surface. Thus, by applying an electric field to the field emission type cathodes, the electron beam emission parts are sharpened and the electric field is efficiently concentrated.

DESCRIPTION OF THE PREFERRED EMBODIMENTS

A field emission type cathode according to the present invention-as will be described hereinafter in detail is a field emission type cathode arranged to face an electron application surface, wherein at least an electron emission part of the field emission type cathode is formed by thin plate-like conductive fine grains; and a plate surface direction of the thin plate-like fine grains of the electron emission part is arranged to be a direction mainly crossing the electron application surface.

An electron emission apparatus having field emission type cathodes of the present invention as constituent elements is an electron emission apparatus having field emission type cathodes arranged to face an electron application surface, wherein at least electron emission parts of the field emission type cathodes are formed by thin plate-like conductive fine grains; and a plate surface direction of the thin plate-like fine grains of the electron emission part is arranged to be a direction mainly crossing the electron application surface; and if an electric field is applied, electrons are emitted from end faces of the thin plate-like fine grains of the electron emission parts of the field emission type cathodes.

Now, as a mode for carrying out the field emission type cathode of the present invention and the electron emission apparatus of the present invention, description will be given hereinafter to the structure of an example of a planar display apparatus 20 with reference to the drawings. It is noted that the present invention should not be limited to the following example.

Figure 1:
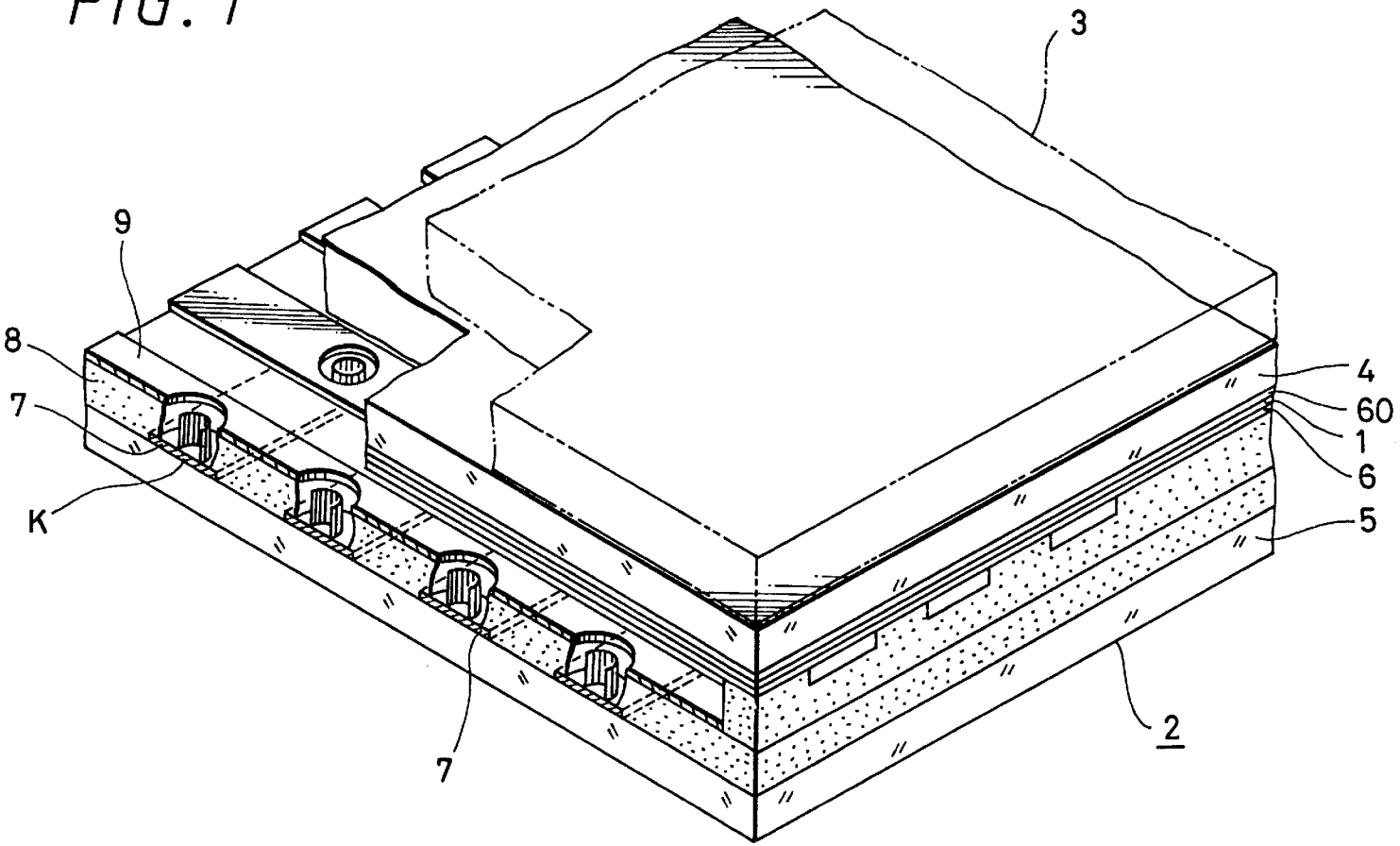
FIG. 1 is a schematic perspective view of a planar display apparatus of the present invention.

A planar display apparatus 20 of the present invention shown in FIG. 1 consists of a display apparatus main body 2 having field emission type cathodes K arranged to face a fluorescent surface 1 and a planar color shutter 3 arranged to contact or face the front surface of the apparatus 20 at the fluorescent surface 1 arrangement side.

Figure 15:
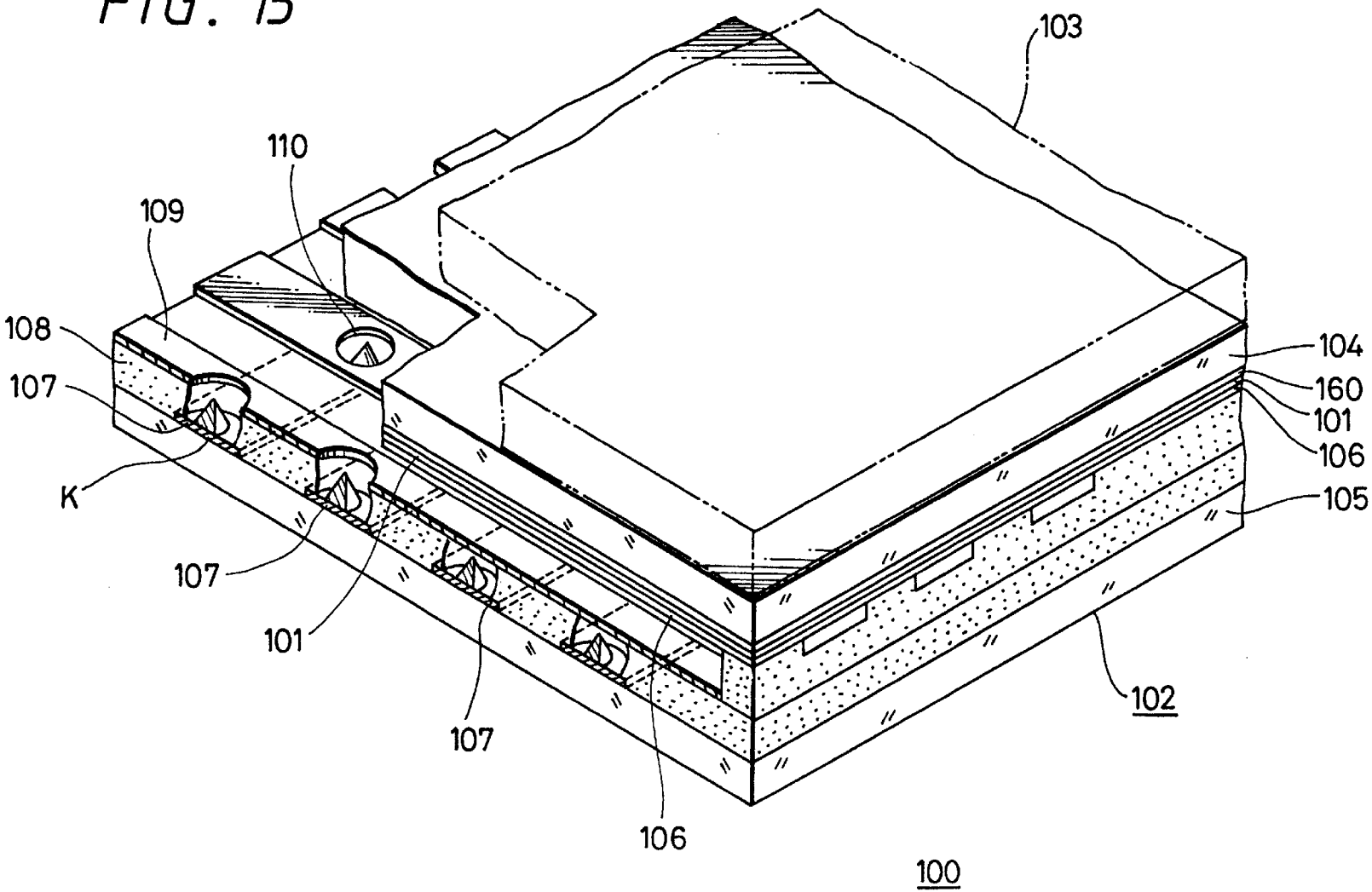
FIG. 15 is a schematic perspective view of a conventional planar image display apparatus.
Figure 16:
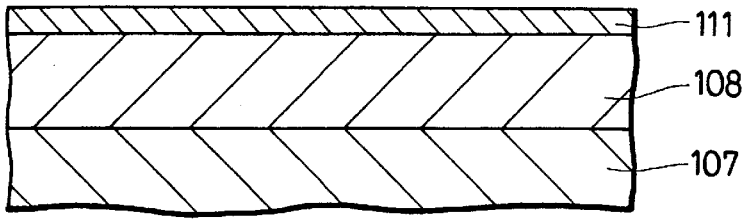
FIG. 16 is a view showing one manufacturing step for a field emission type cathode constituting the conventional planar image display apparatus.
Figure 17:
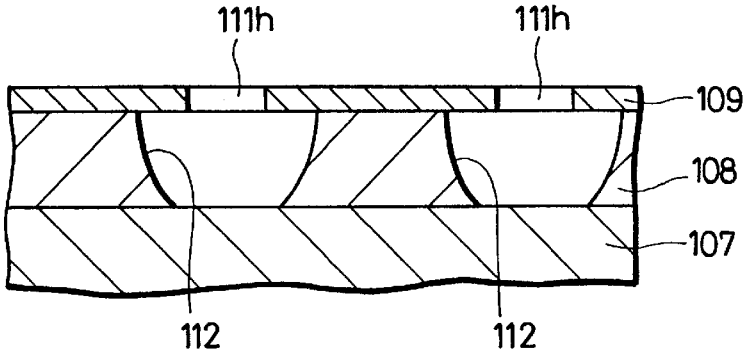
FIG. 17 is a view showing one manufacturing step for the field emission type cathode constituting the conventional planar image display apparatus.
Figure 18:
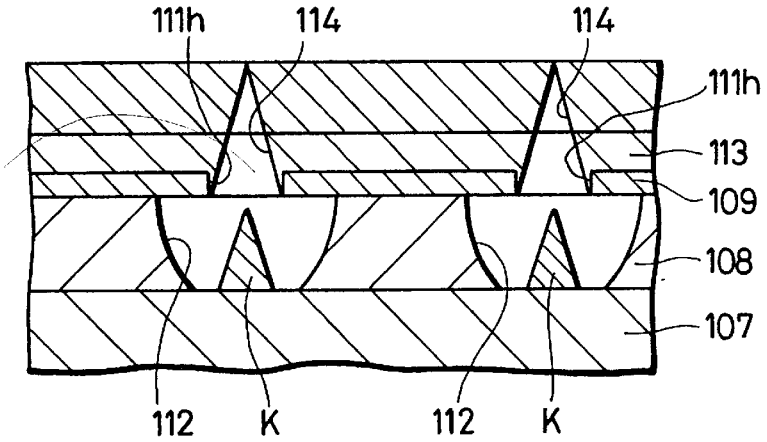
FIG. 18 is a view showing one manufacturing step for the field emission type cathode constituting the conventional planar image display apparatus.
Figure 19:
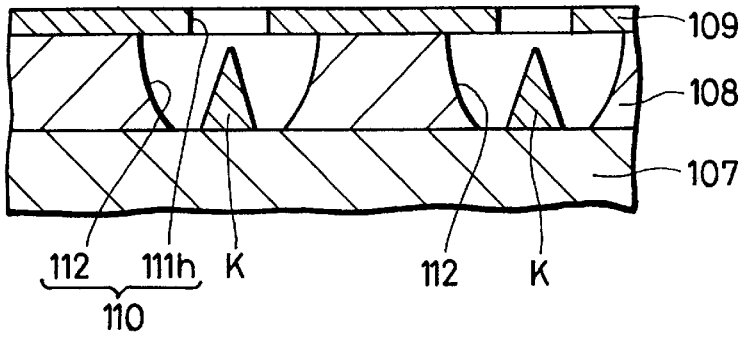
FIG. 19 is a view showing one manufacturing step for the field emission type cathode constituting the conventional planar image display apparatus.

As in the case of the description which has been given with reference to FIG. 15, the display apparatus main body 2 is constituted such that a light transmitting front panel 4 and a back panel 5 face each other through a spacer (not shown) for holding the panels to keep a predetermined length therebetween.

Further, the peripheral edge portions of the front panel 4 and the back panel 5 are airtight sealed by glass frit or the like and a space is formed between the front panel 4 and the back panel 5.

In FIG. 1, an anode metal layer 60, a fluorescent surface 1 entirely coated with a light emission fluorescent material and a metal back layer 6 such as an Al film are formed to be covered with the inner surface of the front panel 4 as in the case of an ordinary cathode ray-tube.

Meanwhile, many cathode electrodes 7 extending, for example, in a band-like manner are formed to be arranged in parallel to one another and coated on the inner surface of the back panel 5 arranged to face the front panel 4.

Gate electrodes 9 are arranged in parallel to one other almost orthogonally, e.g., horizontally to the extension direction of these cathode electrodes 7 through an insulating layer 8.

Field emission type cathodes K are formed between the gate electrodes 9 on the cathode electrodes 7, respectively.

Figure 2:
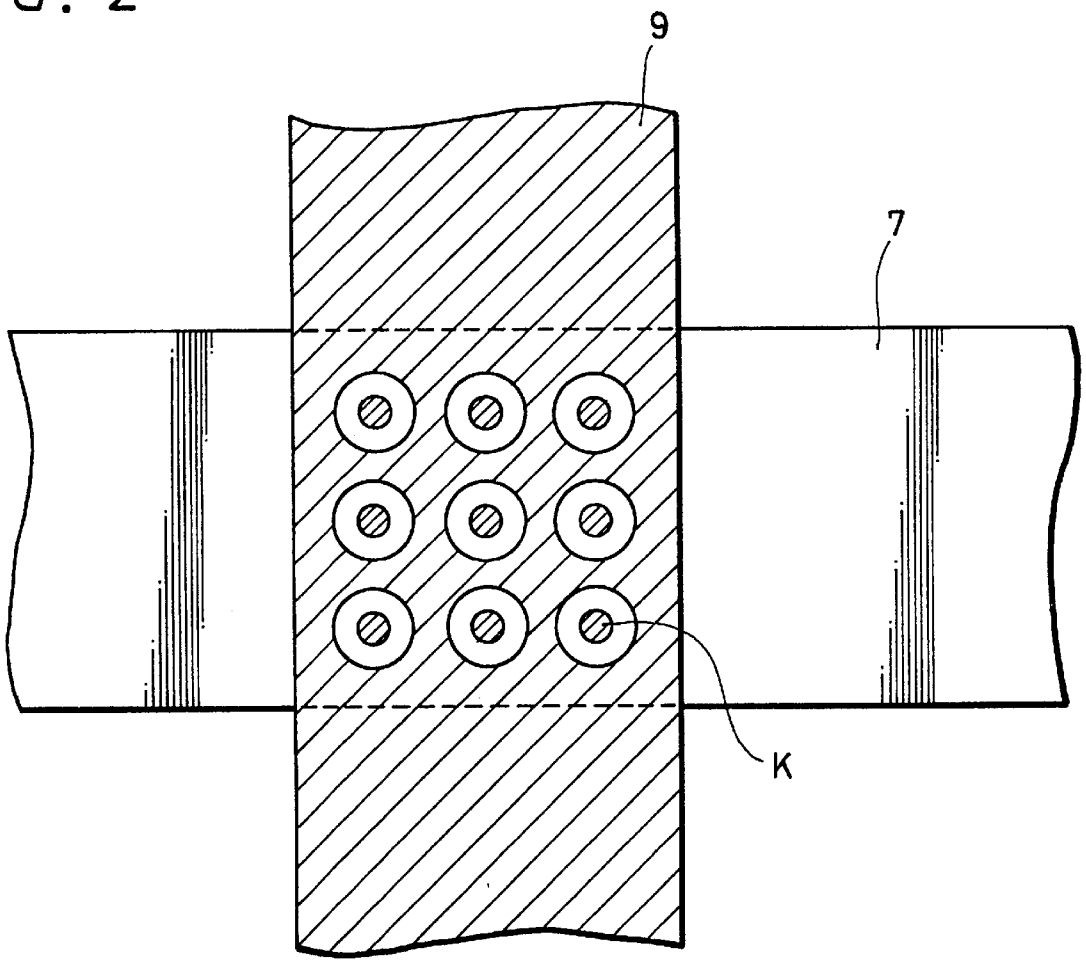
FIG. 2 is a schematic plan view showing the relative positional relationship among a cathode electrode, a gate electrode and a field emission type cathode K constituting the planar image display apparatus of the present invention.

FIG. 2 shows a schematic diagram showing the relative positional relationship among the cathode electrode 7, the gate electrode 9 and the field emission type cathodes K constituting the planar display apparatus 20 of the present invention.

In case of FIG. 2, nine field emission type cathodes K are formed on the cathode electrode 7 between the gate electrodes 9. The field emission apparatus of the present invention should not be limited to this example and modifications can be appropriately made.

Figure 3:
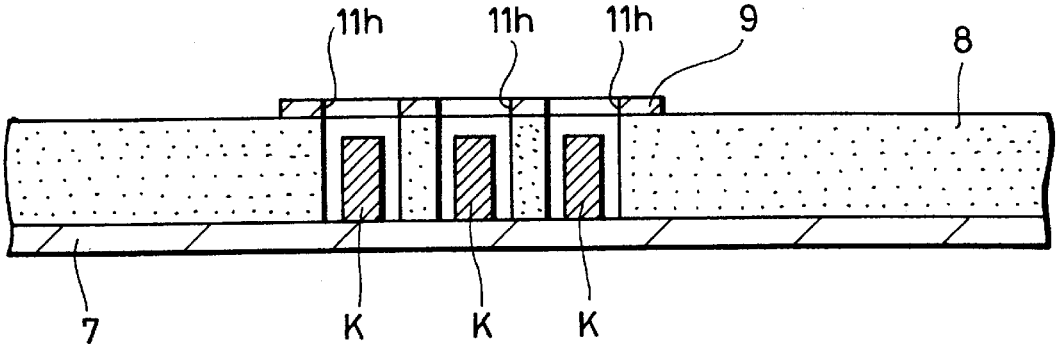
FIG. 3 is a schematic cross-sectional view showing the relative positional relationship among a cathode electrode, a gate electrode and an field emission type cathode K constituting the planar image display apparatus of the present invention.

FIG. 3 shows a schematic cross sectional view showing the relative positional relationship among the cathode electrode 7, the gate electrode 9 and the field emission type cathodes K.

Figure 4:
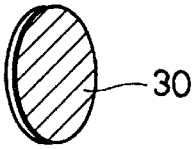
FIG. 4 is a schematic view of a plate-like fine grain constituting the field emission type cathode of the present invention.

The field emission type cathode K shown in FIGS. 2 and 3 has a structure in which thin plate-like fine grains 30 of shape shown in FIG. 4, e.g., circular thin plate shape such as scale shape and made of combined carbon, such as graphite, amorphous carbon, diamond-like carbon or the like, are stacked.

As the thin plate-like fine grains 30, circular plate-like fine grains each having a diameter of, for example, about 500 [nm] and a thickness of, for example, about 20 [nm] can be employed.

Figure 11:
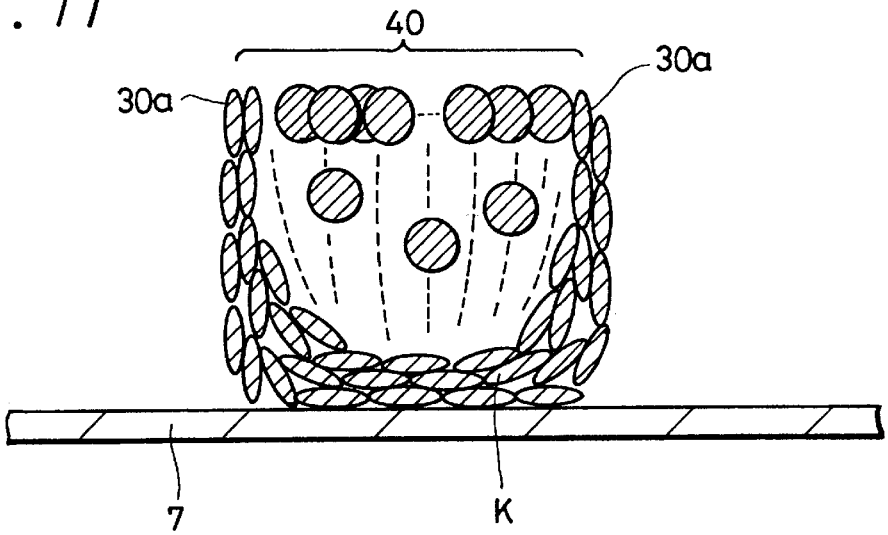
FIG. 11 is a schematic cross-sectional view of an example of the field emission type cathode of the present invention.

As shown in FIG. 11, the plate surface direction of the thin plate-like fine grains 30 of the electron emission part 40 of the field emission type cathode K is arranged to mainly cross an electron application surface. That is to say, the fine grains 30 are placed to stand almost perpendicularly to the image formation surface of the planar display apparatus 20. By doing so, end portions, i.e., edge portions 30*a* of the electron emission part 40 of the field emission type cathode K is sharpened.

As the thin plate-like fine grain 30 shown in FIG. 4, one having an average grain diameter of, for example, not more than 5 [μm] and an average aspect ratio (a value obtained by dividing the square root of the area of the thin plate-like grain by its thickness) of, for example, not less than 5 can be employed. Desirably, thin plate-like fine grains having a grain diameter of not more than 3 [μm] and not more than 0.1 [μm] occupy 40 to 95 wt % of the entire thin plate-like fine grains constituting the field emission type cathode K, the average grain diameter of the thin plate-like fine grains 30 constituting the field emission type cathode K is 0.05 to 0.08 [μm] and the average aspect ratio (a value obtained by diving the square root of the area of the thin plate-like fine grain by its thickness) is not less than 10.

The average grain diameter of the thin plate-like fine grains 30 is set to be a stokes diameter and can be measured by, for example, a centrifugal precipitation light transmission type particle size distribution measurement unit.

If the average grain diameter of the thin plate-like fine grain 30 is larger than 5 [μm], the electron emission part of the field emission type cathode K cannot be sufficiently made small at the time of constituting the cathode K. Judging from. this, it is preferable that the grain diameter of most of the thin plate-like fine grains 30 constituting the field emission type cathode K is not more than 0.1 [μm]. If the fine grains of grain size of not more than 0.1 [μm] occupy less than 40 wt % of the entire thin plate-like fine grains 30 constituting the field emission type cathode K, the shape of the field emission type cathode K becomes disadvantageously irregular if formed with a coating agent having these fine grains 30 dispersed in a solvent.

Based on the above, it is desirable that the average grain diameter of the thin plate-like fine grains 30 constituting the field emission type cathode K is about 0.05 to 0.08 [μm]. It is noted that the grain size distribution can be measured by a light transmission type grain size distribution measurement unit.

If it is also assumed that the radius of curvature of the tip end, that is, edge portion 30*a* of the electron emission part 40 of the field emission type cathode K is ρ, the electric field of the tip end of the field emission type cathode K is E and the potential of the tip end of the field emission type cathode K is V, then the following relational expression is satisfied:

$$E=V/(5\rho).$$

Now, consideration will be given to a case where the potential V of the field emission type cathode K is the electron emission threshold voltage Vt of the field emission type cathode K.

It is preferable that the voltage of the driver circuit of the cathode is several tens of volts to 100 volts in view of transistor performance and price.

The threshold field Et corresponding to Vt depends on a material. In case of a metal material, the threshold field Et is not more than $10^7$ [V/cm]. In case of a carbon material, Et is not more than $10^6$ [V/cm].

For example, at threshold voltage Vt=10 [V] and Et=$10^6$ [V/cm], ρ=10 [V]/5×$10^6$ [V/cm]=0.02 [μm] based on the above expression.

This is the order of the thickness direction of the thin plate-like fine grains 30.

In the meantime, the magnitude of the thin plate-like fine grains in the plate surface direction depends on the magnitude of an emitter. The magnitude of the emitter depends on that of the display of the planar display apparatus.

The magnitude of the pixels of the display depends on the magnitude of the display and the density (resolution) of the pixels. A typical example of high resolution may be a computer display XGA of 17 to 20 inches having 1024×768 pixels and the magnitude of one sub-pixel of about 60 [μm]×100 [μm].

Several tens to several hundreds of emitters are manufactured in the display. Therefore, the magnitude of one emitter is several tens to several microns. To accurately pattern the emitters of this magnitude, it is necessary that the size of a thin plate-like fine grain 30 is sub-micron, that is, about 0.1 to 0.5 [μm]. Therefore, as described above, ρ.=0.02 [μm] and the aspect ratio becomes:

(0.1 to 0.5)/0.02=5 to 25.

Judging from the above, the aspect ratio is preferably not less than 5, more preferably not less than 10.

Now, description will be given to an example of a method of manufacturing the field emission type cathode K of the present invention constituting the planar display apparatus of the present invention, the field emission type cathode K of the present invention which can be manufactured by the method of the present invention and the planar display apparatus of the present invention to which this field emission type cathode K is applied, with reference to the drawings. The present invention should not be, however, limited to the following example.

First, as already described with reference to FIG. 1, cathode electrodes 7 for flowing current to the field emission type cathodes K are formed on the surface of the back panel 5.

A metal layer made of, for example, Cr is formed by deposition, sputtering or the like and then selectively etched by photolithography and each cathode electrode 7 is thereby formed into a predetermined pattern.

Figure 5:
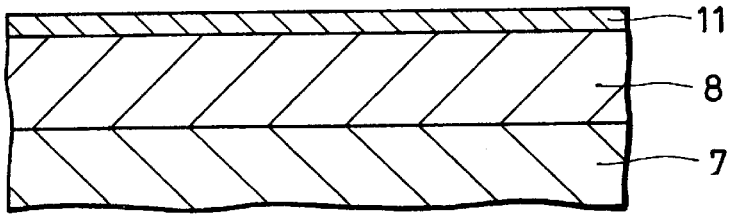
FIG. 5 is a manufacturing step view for the field emission type cathode of the present invention.

Next, as shown in FIG. 5, an insulating layer 8 is coated on the entire surface of the pattered cathode electrode 7 by sputtering or the like. Further, a metal layer 11 made of, for example, high melting point metal such as Mo or W, finally constituting the gate electrode 9 is formed on the insulating layer 8 by deposition, sputtering or the like.

Figure 6:
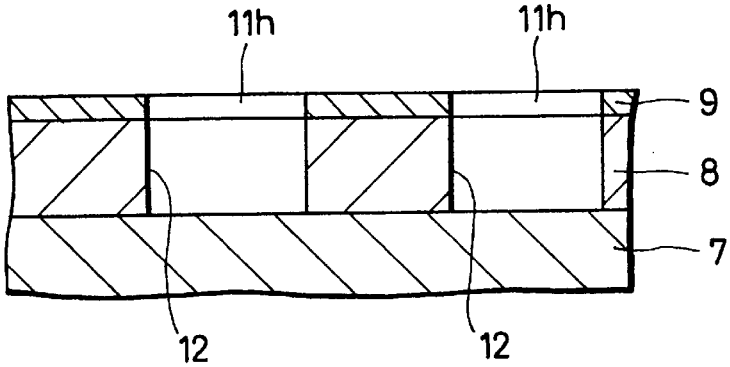
FIG. 6 is a manufacturing step view for the field emission type cathode of the present invention.

Thereafter, as shown in FIG. 6, a resist pattern made of a photoresist (not shown) is formed. Using the resist pattern as a mask, the metal layer 11 is subjected to anisotropic etching such as RIE (reactive ion etching), thereby forming band-like gate electrodes 9 to have a predetermined pattern, i.e., extending in a direction orthogonal to the extension direction of the cathode electrode 7.

Then, for example, a plurality of small holes 11*h* of 15 [μm] in diameter are provided in crossings of the gate electrodes 9 and the cathode electrodes 7, respectively.

Next, through these small holes 11*h*, chemical etching, for example, with which the gate electrode 9, that is, the metal layer 11 is not etched but the insulating layer 8 is etched, is conducted, thereby forming holes 12 each having a width almost equal to that of the small hole 11*h* and a depth corresponding to the entire thickness of the insulating layer 8.

Figure 7:
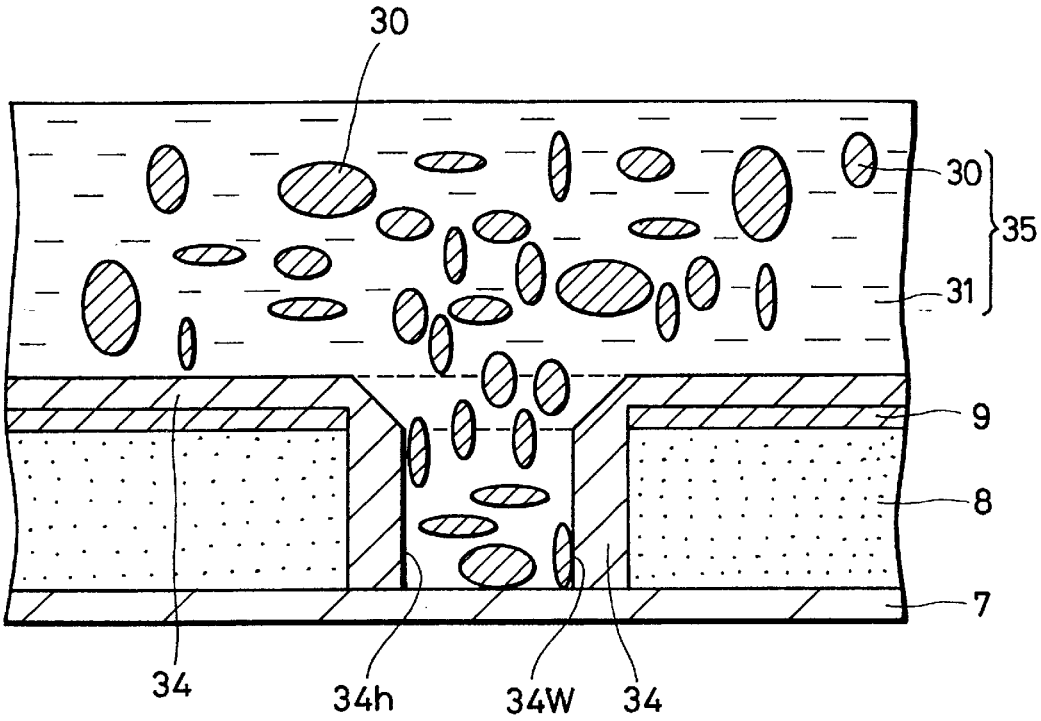
FIG. 7 is a manufacturing step view for the field emission type cathode of the present invention.

Thereafter, as shown in FIG. 7, after the small holes 11*h* and the holes 12 are formed, a photoresist 34 is coated on the surface. The photoresist 34 is dried, exposed by, for example, a high pressure mercury lamp and developed by, for example, alkali development, whereby a photoresist hole 34*h* having a diameter of, for example, 7 [$\mu$m] can be formed in the small hole 11*h* and the hole 12.

As the photoresist 34, both a negative photoresist and a positive photoresist may be applied. For example, a novolak type positive photoresist (manufactured by TOKYO OHKA KOGYO CO., LTD. PMER6020EK) or the like may be used.

Next, scale-like fine grains shown in FIG. 4, i.e., thin plate-like fine grains 30 are dispersed in a solvent 31 such as water or an organic solvent and a coating agent is formed a coating agent 35.

Then, the coating agent 35 is coated on the pattern of the photoresist 34 by, for example, a spinner or a coater on the like, as shown in FIG. 7.

It is noted that thermosetting resin or the like may be added to the solvent 31 in advance to facilitate patterning in a later step.

Thereafter, the coating agent is dried by, for example, a hot plate or the like. At this moment, the thin plate-like fine grains 30 in the photoresist hole 34 are spontaneously oriented along wall portions 34*w*. If the grains 30 are stacked as they are, they are arranged such that the plate surface direction of the thin plate-like fine grains is arranged to be a direction mainly crossing the electron application surface.

Namely, on the wall portions 34*w* of the photoresist, the plane direction of the thin plate-like fine grains 30 is almost perpendicular to that of the cathode electrode 7. Then, pre-bake is carried out and a stack of the thin plate-like fine grains 30 is thereby formed.

Figure 9:
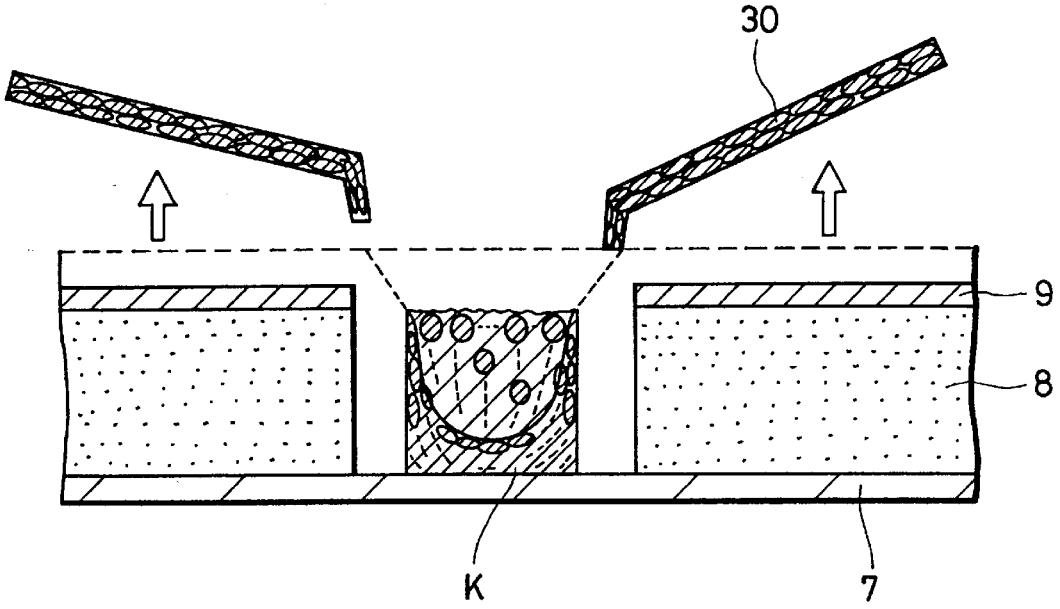
FIG. 9 is a manufacturing step view for the field emission type cathode of the present invention.

Next, as-shown in FIG. 9, the photoresist 34 together with the thin plate-like fine grains 30 stacked on the photoresist 34 is developed and removed by acid or alkali chemicals. If the thin plate-like fine grains 30 are made of graphite, in particular, pure water is sprayed thereon at high pressure after the development and removal step. By doing so, it is possible to ensure that the ultimately intended field emission type cathodes K can be formed into a fine pattern.

Figure 10:
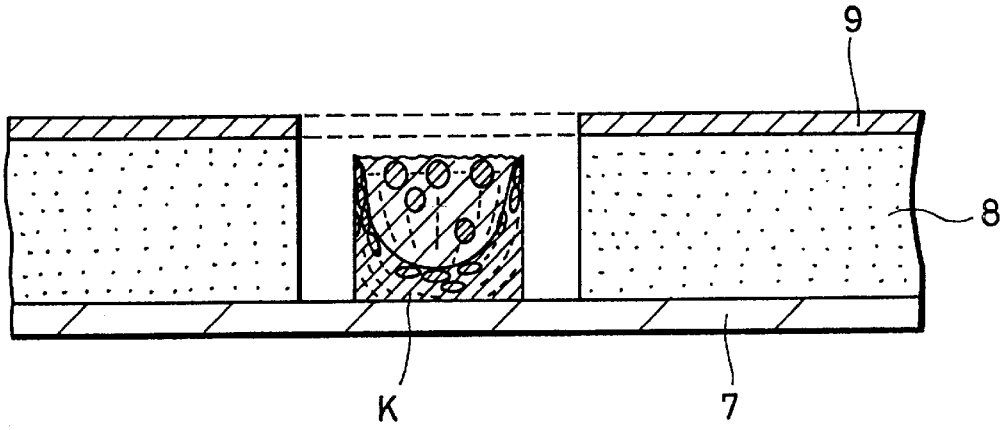
FIG. 10 is a schematic cross-sectional view of the field emission type cathode of the present invention.

Thereafter, a baking step (post-bake) is conducted and a pattern of a field emission type cathode K is formed as shown in FIG. 10.

Figure 12:
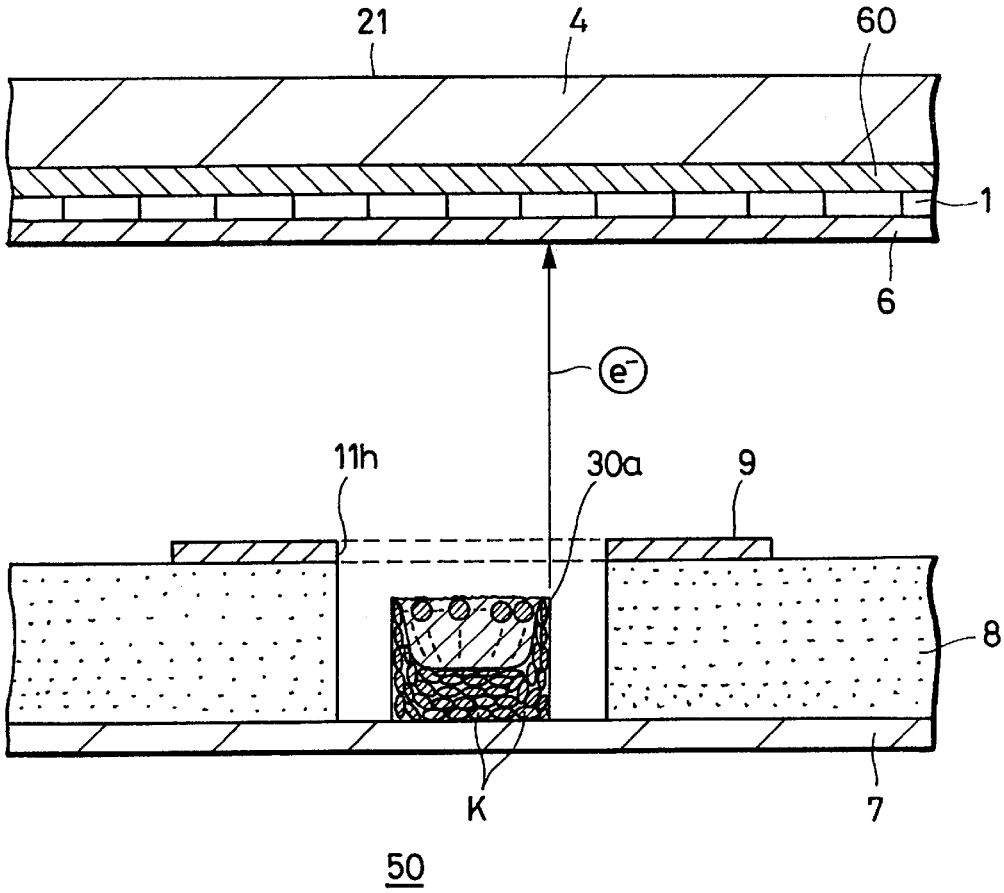
FIG. 12 is a schematic cross-sectional view of an example of the electron emission apparatus of the present invention.

FIG. 11 shows a schematic cross-sectional view of the field emission type cathode K manufactured through the above-stated steps. FIG. 12 shows a schematic cross-sectional view of the electron emission apparatus 50 provided with the electron emission cathodes K of the present invention.

The field emission type cathode K of the present invention is, as shown in FIG. 11, formed in the direction in which the plate surface direction of the thin plate-like fine grains 30 on the edge portions 30*a* of the electron emission part 40 crosses an image formation surface 21 shown in FIG. 12, i.e., an electron application surface.

If thin plate-like fine grains 30, for example, with 20 [nm] in thickness sharper than a conventionally structured field emission type cathode, that is, the tip end portion of a conical shaped cathode the manufacture of which was described in FIG. 16 to FIG. 19 are used, the field emission type cathode K having an edge portion 30*a* with a radius of carvature of 20 [nm] can be formed so that its surface direction and an image formation surface, that is, an electron applying surface are disposed in mutually crossing directions.

As stated above, the field emission type cathode K is formed on the cathode electrode 7 and a cathode structure having the gate electrode 9 formed to cross above the cathode K is arranged to face the fluorescent surface 1, that is, the electron application surface.

In the electron emission apparatus 50 having the field emission type cathodes K formed as stated above, high plate voltage which is positive relative to the cathodes is applied to the fluorescent surface 1, that is, the anode metal layer 60. Besides, voltage with which electrons can be sequentially emitted from the field emission type cathodes K at, for example, the crossings of the cathode electrodes 7 and the gate electrodes 9, is applied between the cathode electrodes 7 and the gate electrode 9, for example, voltage of 100V is applied to the gate electrodes 9 with respect to the cathode electrodes 7 sequentially and according to the display contents. Thus, electron e-beams from the edge portions 30*a* of the electron emission part of the field emission type cathode K are directed toward the fluorescent surface 1.

In this way, the display apparatus main body 2 shown in FIG. 1 can obtain a white picture having light emission patterns corresponding to the respective colors in a time division manner. Besides, synchronously with the time-division display, the main body 2 switches the color shutter 3 and fetches lights corresponding to the respective colors.

Namely, the display apparatus main body 2 sequentially fetches red, green and blue optical images and displays a color image as a whole.

As described above, according to the electron emission apparatus 50 of the present invention, the edge portions 30*a* on the electron emission part of the field emission type cathode K to concentrate the electron field formed on the cathode electrode 7 can be formed to be sharper than the conventional conical field emission type cathode K by simpler manufacturing steps.

Further, at least the electron emission part 40 of the field emission type cathode K of the present invention is formed out of thin plate-like conductive fine grains 30 and the cathode K is formed so that the plane direction of the thin plate-like conductive fine grains on the edge portions 30*a* may cross that of the electron application surface. Thus, it is possible to make the edge portions 30*a* sharper and to realize efficient electron emission.

Furthermore, the planar display apparatus 20 shown in FIG. 1 can be applied to a case where red, green and blue fluorescent substances are separately coated besides a case where the white fluorescent surface is provided on the image formation surface. Thus, the configuration of the planar display apparatus can be changed appropriately.

Figure 13:
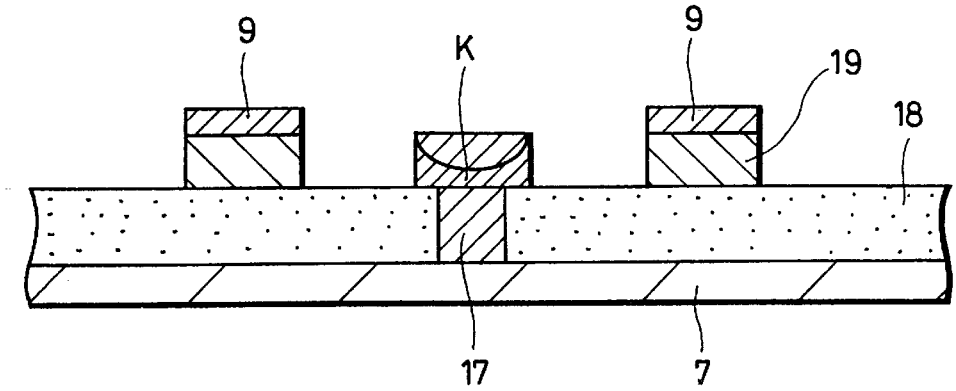
FIG. 13 is a schematic cross-sectional view of the important parts of another example of the electron emission apparatus of the present invention.

Moreover, in the above-stated example, as shown in FIG. 12 or the like, description has been given to a case where the field emission type cathodes K are directly formed on the cathode electrodes 7. The present invention should not be, however, limited to this example. Namely, as shown in FIG. 13, the present invention is also applicable to a case where an insulating layer 18 is formed on cathode electrodes 7, the cathode electrode 7 formed below the insulating layer 18 by perforating a predetermined portion of the insulating layer 18 and a field emission type cathode K are coupled to each other by a conductive layer 17 made of tungsten or the like, to thereby make the cathode electrode 7 and the cathode K continuous to each other.

Furthermore, in the above-stated example, description has been given to a case where thin plate-like conductive fine grains 30 are stacked on a smooth surface in constituting the field emission type cathode K. The present invention should not be limited to this example and can be also applied to a case where the fine grains 30 are formed on a surface having predetermined irregular portions.

Additionally, in the above-stated example, description has been given to a case where the field emission type cathode K of the present invention is formed so that the plane direction of the thin plate-like fine grains 30 on the electron emission part faces and crosses the electron application surface in almost perpendicular direction. The present invention should not be limited to this example.

Figure 14:
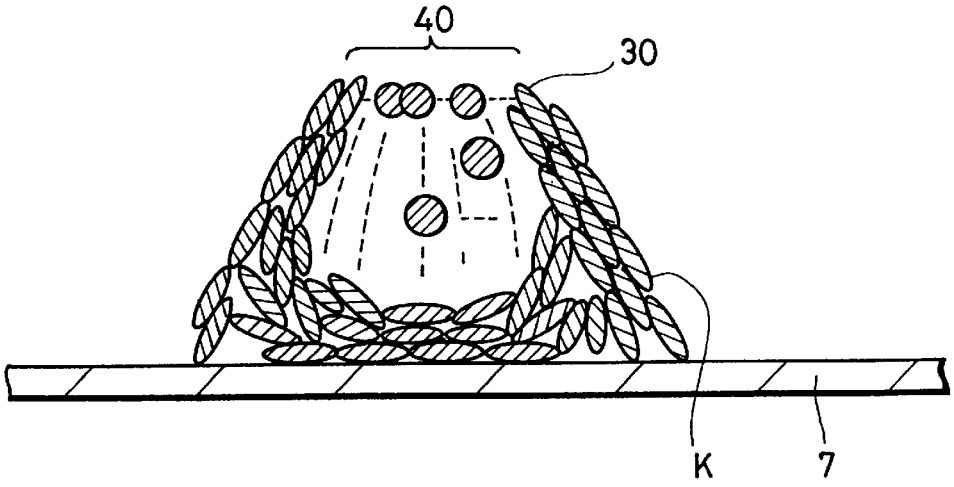
FIG. 14 is a schematic cross-sectional view of another example of the field emission type cathode of the present invention.

That is to say, the plane direction of the thin plate-like fine grains 30 may cross that of the electron application surface so that the edge portions 30*a* of the electron emission part of the field emission type cathode K face the electron application surface and can be sharpened. As shown in FIG. 14, for example, the edge portions can be slightly inclined.

Figure 8:
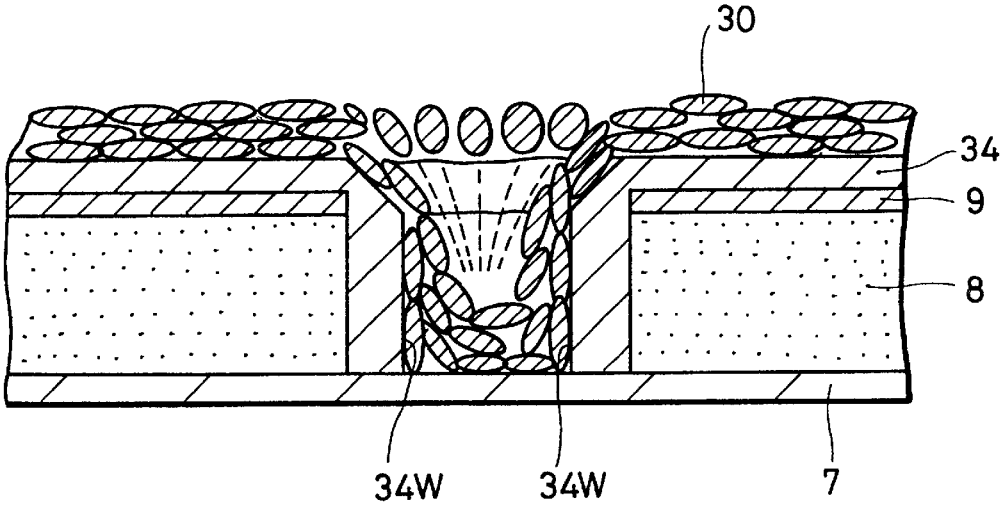
FIG. 8 is a manufacturing step view for the field emission type-cathode of the present invention.

It is noted that the field emission type cathode K formed to be slightly inclined as shown in FIG. 14 can be formed by forming the end faces of the photoresist 34 described with reference to FIG. 8 to have an inverse trapezoidal cross section by adjusting required exposure conditions.

According to the field emission type cathode K and the electron emission apparatus 50 of the present invention, at least the electron emission part 40 of the field emission type cathode K is formed out of thin plate-like fine grains 30 and the cathode K is formed so that the plane direction of the thin plate-like fine grains 30 on the electron emission part crosses the electron application surface of the electron emission apparatus 50. This makes it possible to sharpen the edge portions 30*a* of the electron emission part 40 of the field emission type cathode K. It is, therefore, possible to efficiently concentrate the electric field and to improve electron emission efficiency.

Furthermore, according to the electron emission apparatus manufacturing method of the present invention, the edge portions 30*a* of the electron emission part 40 of the field emission type cathode K can be made sharper than those of the electron emission part of the electron emission apparatus of the conventional structure.

Hence, it is possible for the field emission type cathode K to efficiently concentrate the electric field and to thereby improve electron emission efficiency.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A field emission cathode arranged to face an electron application surface, characterized in that at least an electron emission part of the field emission cathode is formed by thin plate-like conductive fine grains, said thin plate-like fine grains being generally circular plate shaped and having an average grain diameter of not more than 5 $\mu$m, and an average aspect ratio (a value obtained by dividing a square root of an area by a thickness) of the grains is not less than 5; and a plate surface direction of said thin plate-like fine grains of said electron emission part is arranged to be a direction mainly crossing said electron application surface.

2. A field emission cathode according to claim 1, characterized in that said thin plate-like fine grains consist of carbon combination.

3. An electron emission apparatus having field emission cathodes arranged to face an electron application surface, characterized in that at least electron emission parts of the field emission cathodes are formed by thin plate-like conductive fine grains, said thin plate-like fine grains being generally circular plate shaped and having an average grain diameter of not more than 5 $\mu$m; and an average aspect ratio (a value obtained by dividing a square root of an area by a thickness) of the grains is not less than 5; and a plate surface direction of said thin plate-like fine grains of said electron emission part is arranged to be a direction mainly crossing said electron application surface; and if an electric field is applied, electrons are emitted from end faces of the thin plate-like fine grains of the electron emission parts of said field emission cathodes.

4. An electron emission apparatus according to claim 3, characterized in that said thin plate-like fine grains constituting said field emission cathodes consist of carbon combinations.

5. A field emission cathode comprising:

a cathode electrode having a base and a plurality of grains, wherein said base is below an insulating layer, said insulating layer having an opening therein, a portion of said base being exposed by said opening, said opening having a sidewall, wherein said plurality of grains are within said opening, said plurality of grains conforming to and in contact with said sidewall, a grain of said plurality of grains being above and in contact with another grain of said plurality of grains.

6. A field emission cathode according to claim 5, wherein said sidewall is removed to expose said base.

7. A field emission cathode according to claim 5, wherein said grain has a length and a width, said length being longer than said width, said grain extending from said base in the direction of said length.

8. A field emission cathode according to claim 7, wherein said direction of said length is a plate surface direction, said plate surface direction is arranged to be a direction mainly crossing an electron application surface.

9. A field emission cathode according to claim 7, wherein said length is substantially parallel with said sidewall.

10. A field emission cathode according to claim 5, wherein said grain is adjacent to and in contact with another grain of said plurality of grains.

11. A field emission cathode according to claim 5, wherein said grain has a substantially circular profile.

12. A field emission cathode according to claim 5, wherein said grain is structurally and electrically adapted to emit electrons.

13. A field emission cathode according to claim 5, wherein said grain has an average grain diameter of not more than 5 $\mu$m.

14. A field emission cathode according to claim 5, wherein said grain has an average grain diameter of approximately 0.05 $\mu$m to 0.08 $\mu$m.

15. A field emission cathode according to claim 5, wherein said grain has a grain diameter of not more than 0.1 $\mu$m.

16. A field emission cathode according to claim 5, wherein said grain has an average aspect ratio of the grains is not less than 5, said average aspect ratio being obtained by dividing a square root of an area of said grain by a thickness of said grain.

17. A field emission cathode according to claim 5, wherein said grain has an average aspect ratio of the grains is not less than 10, said average aspect ratio being obtained by dividing a square root of an area of a grain of said plurality of grains by a thickness of said grain.

18. A field emission cathode according to claim 5, wherein each grain of said plurality of grains is formed from the same material.

19. A field emission cathode according to claim 5, wherein said grain includes carbon.

20. A field emission cathode according to claim 19, wherein said carbon is graphite.

21. A field emission cathode according to claim 19, wherein said carbon is amorphous carbon.

22. A field emission cathode according to claim 19, wherein said carbon is diamond-like carbon.

23. A electron emission apparatus comprising:

a field emission cathode, said field emission cathode including a cathode electrode having a base and a plurality of grains, wherein said base is below an insulating layer, said insulating layer having an opening therein, a portion of said base being exposed by said opening, said opening having a sidewall, wherein said plurality of grains are within said opening, said plurality of grains conforming to and in contact with said sidewall, a grain of said plurality of grains being above and in contact with another grain of said plurality of grains.

24. A electron emission apparatus according to claim 23, further comprising:

at least one gate electrode, a fluorescent surface, an anode, a transmitting front panel, said least one gate electrode layer being above said insulating layer and having a gate electrode layer opening, said base being exposed through said gate electrode layer opening, said field emission cathode emitting electrons through said gate electrode layer opening, said fluorescent surface being located between said at least one gate electrode and said anode and said gate electrode layer, said fluorescent surface being coated with a light emission fluorescent material, said anode being above said least one gate electrode layer and including another metal, a vacuum existing between said anode and said least one gate electrode layer, said front panel being adapted to transmit light.

25. A electron emission apparatus according to claim 24, further comprising:

a back layer and a color shutter, said back layer being located between said at least one gate electrode and said fluorescent surface, back layer including a metal, said color shutter being above said front panel.

26. A electron emission apparatus according to claim 23, wherein said sidewall is removed to expose said base.

27. A electron emission apparatus according to claim 23, wherein said grain has a length and a width, said length being longer than said width, said grain extending from said base in the direction of said length.

28. A electron emission apparatus according to claim 27, wherein said direction of said length is a plate surface direction, said plate surface direction is arranged to be a direction mainly crossing an electron application surface.

29. A electron emission apparatus according to claim 27, wherein said length is substantially parallel with said sidewall.

30. A electron emission apparatus according to claim 23, wherein said grain is adjacent to and in contact with another grain of said plurality of grains.

31. A electron emission apparatus according to claim 23, wherein said grain has a substantially circular profile.

32. A electron emission apparatus according to claim 23, wherein said grain is structurally and electrically adapted to emit electrons.

33. A electron emission apparatus according to claim 23, wherein said grain has an average grain diameter of not more than 5 $\mu$m.

34. A electron emission apparatus according to claim 23, wherein said grain has an average grain diameter of approximately 0.05 $\mu$m to 0.08 $\mu$m.

35. A electron emission apparatus according to claim 23, wherein said grain has a grain diameter of not more than 0.1 $\mu$m.

36. A electron emission apparatus according to claim 23, wherein said grain has an average aspect ratio of the grains is not less than 5, said average aspect ratio being obtained by dividing a square root of an area of said grain by a thickness of said grain.

37. A electron emission apparatus according to claim 23, wherein said grain has an average aspect ratio of the grains is not less than 10, said average aspect ratio being obtained by dividing a square root of an area of a grain of said plurality of grains by a thickness of said grain.

38. A electron emission apparatus according to claim 23, wherein each grain of said plurality of grains is formed from the same material.

39. A electron emission apparatus according to claim 23, wherein said grain includes carbon.

40. A electron emission apparatus according to claim 39, wherein said carbon is graphite.

41. A electron emission apparatus according to claim 39, wherein said carbon is amorphous carbon.

42. A electron emission apparatus according to claim 39, wherein said carbon is diamond-like carbon.

* * * * *

UNITED STATES PATENT AND TRADEMARK OFFICE

CERTIFICATE OF CORRECTION

PATENT NO. : 6,498,424 B1
DATED : December 24, 2002
INVENTOR(S) : Ichiro Saito et al.

It is certified that error appears in the above-identified patent and that said Letters Patent is hereby corrected as shown below:

Title page,
Item [76], should read as follows:
-- Ichiro Saito, Kanagawa, JAPAN; Kouji Inoue, Kanagawa, JAPAN; Shinichi Tachizono, Chiba, JAPAN; Takeshi Yamagishi, Chiba, JAPAN. --
Item [73], should read as follows:
-- Assignee: Sony Corporation, Tokyo (JP); Hitachi Powdered Metals Co., Ltd, Chiba-ken (JP). --

Column 13,
Lines 20, 33 and 54, replace "A" with -- An --.

Column 14,
Lines 5, 7, 11, 14 and 18, replace "A" with -- An --.
Lines 20, 22, 25 and 28, replace "A" with -- An --.
Lines 31, 34, 39 and 44, replace "A" with -- An --.
Lines 47, 49, 51 and 53, replace "A" with -- An --.

Signed and Sealed this

Sixteenth Day of December, 2003

JAMES E. ROGAN
*Director of the United States Patent and Trademark Office*